US007855537B2

(12) United States Patent
Aizawa

(10) Patent No.: US 7,855,537 B2
(45) Date of Patent: Dec. 21, 2010

(54) VOLTAGE SUPPLY CIRCUIT

(75) Inventor: Hiroki Aizawa, Kanagawa (JP)

(73) Assignee: NEC Electronics Corporation, Kawasaki (JP)

( * ) Notice: Subject to any disclaimer, the term of this patent is extended or adjusted under 35 U.S.C. 154(b) by 598 days.

(21) Appl. No.: 11/979,609

(22) Filed: Nov. 6, 2007

(65) Prior Publication Data

US 2008/0106245 A1 May 8, 2008

(30) Foreign Application Priority Data

Nov. 7, 2006 (JP) ..... 2006-301301

(51) Int. Cl.
*G05F 1/573* (2006.01)

(52) U.S. Cl. ..... 323/277; 323/281; 361/93.9

(58) Field of Classification Search ..... 323/273–281; 361/93.1, 93.7, 93.9
See application file for complete search history.

(56) References Cited

U.S. PATENT DOCUMENTS 5,739,712 A 4/1998 Fujii
7,012,791 B2 * 3/2006 Kikuchi ..... 323/277
7,015,680 B2 * 3/2006 Moraveji et al. ..... 323/274
7,573,689 B2 * 8/2009 Hojo ..... 361/93.1
2007/0188958 A1 * 8/2007 Sase et al. ..... 361/93.1

FOREIGN PATENT DOCUMENTS

JP 2000-133721 5/2000
JP 2002-304225 10/2002
JP 2003-186555 A 7/2003
JP 2005-293067 10/2005

OTHER PUBLICATIONS

Chinese Office Action dated Aug. 4, 2010, with English translation.

* cited by examiner

*Primary Examiner*—Jessica Han
(74) *Attorney, Agent, or Firm*—McGinn IP Law Group, PLLC

(57) ABSTRACT

A voltage supply circuit includes an output transistor causing a first current to flow to an output terminal of the voltage supply circuit based on a control voltage applied from an error amplifier to a control terminal of the output transistor; and an overcurrent protection circuit including a reference transistor causing a second current to flow to the output terminal, the second current having an amount corresponding to an amount of the first current, the overcurrent protection circuit regulating a level of the control voltage based on comparison between a detection voltage caused based on the second current and a reference voltage.

19 Claims, 11 Drawing Sheets

VOLTAGE SUPPLY CIRCUIT

DESCRIPTION OF RELATED ART

1. Field of the Invention

This invention relates to a voltage supply circuit.

2. Description of Related Art

In recent years, voltage supply circuits have been multifunctionalized. Especially, a technique relating to a method for protecting an output transistor included in the voltage supply circuit from an overcurrent has been rapidly progressing (See Japanese Unexamined Patent Application Publications No. 2000-133721, No. 2005-293067, No. 2003-186555, and No. 2002-304225).

An overcurrent protection circuit is required to have a characteristic for detecting the overcurrent with high accuracy in addition to a first characteristic or a second characteristic. The first characteristic is for decreasing a value of an output voltage while an output current is set constant at the time the output current rises over a predetermined threshold. The second characteristic is for decreasing the output current at the time the output voltage decreases below a predetermined threshold. Note that both of the first and second characteristics are for protecting the output transistor from being damaged by heat. The second characteristic is superior to the first characteristic from a view point of decreasing a thermal loss.

In addition to the above-mentioned characteristics, lower power consumption in the voltage supply circuit is also demanded. For example, Japanese Unexamined Patent Application Publication No. 2002-304225 shows a technique causing a reference current to flow to GND. A value of the reference current corresponds to a value of an output current that flows in the output transistor. With this configuration, higher power consumption of the voltage supply circuit is required.

Japanese Unexamined Patent Application Publication No. 2005-293067 shows a technique to decrease an increase of power consumption by connecting a drain terminal of a reference transistor with an output terminal. In this case, detecting the overcurrent with high accuracy could not be achieved because the overcurrent is detected using a threshold of a transistor. A threshold of a MOS (Metal Oxide Semiconductor) transistor is varied through production process or by a variation in joint-surface temperature.

As explained above, a voltage supply circuit having a characteristic of the overcurrent protection while decreasing power consumption is strongly desired.

SUMMARY

In one embodiment, a voltage supply circuit includes an output transistor producing a first current flowing into an output terminal in response to a control voltage supplied thereto from an error amplifier; and an overcurrent protection circuit including a reference transistor producing a second current flowing into the output terminal relative to the first current, the overcurrent protection circuit regulating the control voltage in response to a comparison between a detection voltage based on the second current and a reference voltage.

In another embodiment, a voltage supply circuit includes an output transistor outputting a first current to an output terminal in response to a control voltage applied thereto from an error amplifier; a reference transistor outputting a second current relative to the first current to the output terminal; a comparator comparing a detection voltage based on the second current with a reference voltage to produce an overcurrent detection signal; and a control voltage regulation circuit regulating a level of the control voltage in response to the overcurrent detection signal.

In still another embodiment, a voltage supply circuit includes an output terminal; an output transistor generating a first current flowing into the output terminal in response to a control voltage applied from an error amplifier; a reference transistor generating a second current flowing into the output terminal in response to the control voltage applied from the error amplifier; a reference voltage generation circuit generating a reference voltage; a detection voltage generation circuit generating a detection voltage in response to the second current; a comparator comparing the detection voltage with the reference voltage to output an overcurrent detection signal; and a regulator regulating a level of the control voltage in response to the overcurrent detection signal.

The overcurrent flowing in the output transistor is detected based on comparison between the detection voltage and the reference voltage. This makes it possible to detect the overcurrent more precisely. And also internal current consumption is suppressed by both of the first and second current flowing into the output terminal.

It is possible to provide a voltage supply circuit having a characteristic of the overcurrent protection while decreasing internal power consumption.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF THE PREFERRED EMBODIMENTS

The invention will now be described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Figure 1:
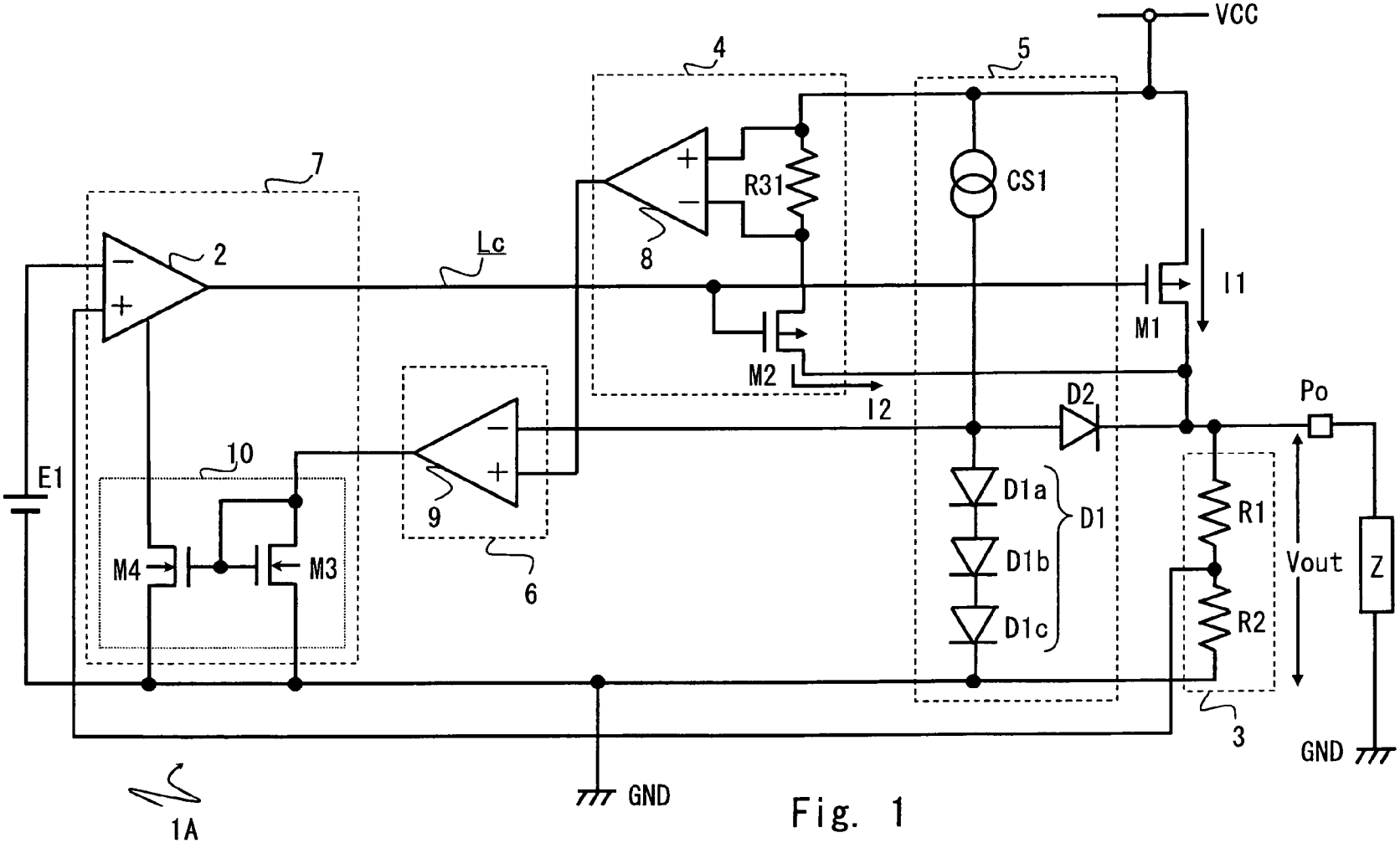
FIG. 1 is a schematic circuit diagram of a voltage supply circuit according to a first embodiment of the present invention.

FIG. 1 shows a voltage supply circuit 1A according to the first embodiment. As shown in FIG. 1, the voltage supply circuit 1A includes a reference voltage source E1, an output transistor M1, a voltage division circuit 3, an output terminal Po, a detection circuit 4, a reference voltage generation circuit 5, a judgment circuit 6, and a control voltage regulation circuit 7. A load Z is connected to the output terminal Po.

The voltage division circuit 3 includes a resistor R1 and a resistor R2. The detection circuit 4 includes a reference transistor M2, a resistor R31, and a differential amplifier 8. The reference voltage generation circuit 5 includes a current source CS1, a first diode section D1, and a second diode section D2. The judgment circuit 6 includes a comparator 9. The control voltage regulation circuit 7 includes a current-mirror circuit 10, and an error amplifier 2.

An output voltage regulation circuit and an overcurrent protection circuit are included in the voltage supply circuit 1A. The output voltage regulation circuit includes the reference voltage source E1, the error amplifier 2, the output transistor M1, the voltage division circuit 3, and the output terminal Po. The overcurrent protection circuit includes the detection circuit 4, the reference voltage generation circuit 5, the judgment circuit 6, and the control voltage regulation circuit 7.

The output voltage regulation circuit operates to maintain a value of an output voltage Vout of the voltage supply circuit 1A constant. The value of the output voltage Vout is set to a constant value by controlling an on-resistance of the output transistor M1 based on a control voltage applied to a control terminal (a gate terminal) of the output transistor M1 from the error amplifier 2.

The overcurrent protection circuit operates to protect the output transistor M1 from a first current I1 (the overcurrent) when it is detected that a value of the first current I1 flowing in the output transistor M1 rises above a predetermined threshold.

A connection relationship of circuit elements and functioning of circuit elements are explained below. An output terminal of the error amplifier 2 is connected to the gate terminal of the output transistor M1 via a line Lc. A source terminal of the output transistor M1 is connected to a power source voltage VCC (a first power supply voltage). A drain terminal of the output transistor M1 is connected to the output terminal Po. Note that the output transistor M1 is p-type.

An inverting input terminal of the error amplifier 2 is connected to the reference voltage source E1. A reference voltage is applied to the inverting input terminal of the error amplifier 2. A non-inverting input terminal of the error amplifier 2 is connected to a node between the resistor R1 and the resistor R2 which are included in the voltage division circuit 3. A divided voltage is applied to the non-inverting input terminal of the error amplifier 2.

The voltage division circuit 3 includes the resistor R1 and the resistor R2 as mentioned above. The resistors R1 and R2 are connected in series between the output transistor and GND (a second power supply voltage). A first end of the resistor R1 is connected to the drain terminal of the output transistor M1 and a second end of the resistor R1 is connected to a first end of the resistor R2. The first end of the resistor R2 is connected to the second end of the resistor R1 and the second end of the resistor R2 is connected to GND. The output voltage Vout is divided by the voltage division circuit 3 and a divided voltage is generated at a node between the resistor R1 and the resistor R2.

The error amplifier 2 amplifies a difference between the divided voltage and the reference voltage. The error amplifier 2 outputs the control voltage corresponding to the difference between the divided voltage and the reference voltage. The on-resistance of the output transistor M1 is controlled based on the control voltage output from the error amplifier 2 for maintaining the output voltage Vout constant.

The output voltage Vout fluctuates as a resistance value of the load Z fluctuates. The divided voltage generated at the node between the resistors R1 and R2 fluctuate as the output voltage Vout fluctuates.

The error amplifier 2 amplifies a difference between the reference voltage from the reference voltage source E1 and the divided voltage from the voltage division circuit 3. Then the error amplifier 2 outputs the control voltage reflecting a change in the difference between the reference voltage and the divided voltage. In other words, the error amplifier 2 controls a potential level of the control terminal of the output transistor M1 and controls the on-resistance of the output transistor M1. The error amplifier 2 controls the output transistor M1 to compensate for the fluctuation in the output voltage Vout.

When the divided voltage decreases, the error amplifier 2 controls a level of the control voltage so as to decrease the on-resistance of the output transistor M1. And a current I1 (the first current I1) that flows into the output terminal Po via the output transistor M1 is increased accordingly. And the decrease in the output voltage Vout is effectively suppressed.

When the divided voltage increases, the error amplifier 2 controls a level of the control voltage so as to increase the on-resistance of the output transistor M1. And the first current I1 that flows into the output terminal Po via the output transistor M1 is decreased accordingly. And the increase in the output voltage Vout is effectively suppressed.

As mentioned above, the overcurrent protection circuit includes the detection circuit 4, the reference voltage generation circuit 5, the judgment circuit 6, and the control voltage regulation circuit 7. The overcurrent protection circuit operates to protect the output transistor M1 from the first current I1 (the overcurrent) when a value of the first current I1 increases above the predetermined threshold. Note that the overcurrent protection circuit protects the load Z connected to the output terminal Po in addition to the output transistor M1 from the overcurrent.

The detection circuit 4 includes the reference transistor M2, the resistor R31, and the differential amplifier 8. Note that the reference transistor M2 is a p-type MOS transistor.

A gate terminal of the reference transistor M2 is connected to the output terminal of the error amplifier 2. A source terminal of the reference transistor M2 is connected to the power source voltage VCC via the resistor R31. A drain terminal of the reference transistor M2 is connected to the output terminal Po. The resistor R31 is connected between the power supply voltage VCC and the reference transistor M2. The resistor R31 and the reference transistor M2 are connected in series.

Input terminals of the differential amplifier 8 are connected to both ends of the resistor R31. That is, an inverting input terminal of the differential amplifier 8 is connected to a node between the resistor R31 and the reference transistor M2. A non-inverting input terminal of the differential amplifier 8 is connected to a node between the resistor R31 and VCC. The differential amplifier 8 amplifies a detection voltage generated by the resistor R31. And the differential amplifier 8 outputs the amplified detection voltage to a non-inverting input terminal of the comparator 9.

As mentioned above, the gate terminal of the output transistor M1 is connected to the output terminal of the error amplifier 2. The gate terminal of the reference transistor M2 is connected to the output terminal of the error amplifier 2. And the same control voltage is applied to the gate terminals of the output transistor M1 and the reference transistor M2 from the error amplifier 2. So a second current I2 has a value corresponding to a value of the first current I1. Note that the second current I2 flows to the output terminal Po via the resistor R31 and the reference transistor M2. And the detection voltage is generated between the both ends of the resistor R31.

The second current I2 has a value corresponding to a value of the first current I1. The detection voltage has a value corresponding to the first current I1 because the detection voltage is caused by an IV-conversion of the second current I2. An amount of the first current I1 is approximated to the detection voltage and the comparator 9 compares the detection voltage with the reference voltage. Thus it becomes possible to detect the overcurrent with high accuracy.

As mentioned above, the reference voltage generation circuit 5 includes the current source CS1, the first diode section D1, and the second diode section D2.

The first diode section D1 is connected between the current source CS1 and GND in a forward direction. The first diode section D1 includes three diodes. The first diode section D1 includes a diode D1*a*, a diode D1*b*, and a diode D1*c* which are connected in series. An anode of the diode D1*a* is connected to the current source CS1 and the inverting input terminal of the comparator 9. A cathode of the diode D1*c* is connected to the GND. Note that the anode of the diode D1*a* constitutes an anode of the diode section D1 and the cathode of the diode D1*c* constitutes a cathode of the diode section D1.

The diode section D2 is connected between the current source CS1 and the output terminal Po in a forward direction. The diode section D2 includes one diode D2. An anode of the diode D2 is connected to the inverting input terminal of the comparator 9 and a cathode of the diode D2 is connected to the output terminal Po.

The diode section D1 and the diode section D2 are connected in parallel against the current source CS1. Each of the diode section D1 and the diode section D2 are connected to the current source CS1 in series. Current from the current source CS1 flows via the first diode section D1 or the second diode section D2.

In a normal state, a level of the output voltage Vout is higher than a level of a falling voltage of the diode section D1 in a forward direction. Therefore, current from the current source CS1 flows into the diode section D1. But when the resistance value of the load Z connected to the output terminal Po decreases and a level of the output voltage Vout is below the predetermined threshold, current from the current source CS1 starts to flow into the diode section D2. In this way, current path is switched. Note that the number of diode included in the first diode section D1 is larger than that included in the second diode section D2, by having such a configuration, the switching of current path can be suitably realized.

Both of the anode of the first diode section D1 and the anode of the second diode section D2 are connected to the inverting input terminal of the comparator 9. When current from the current source CS1 flows into the first diode section D1, a voltage VD1 generated in the first diode section D1 is applied to the inverting input terminal of the comparator 9. When current from the current source CS1 flows into the second diode section D2, a sum voltage VD2+Vout is applied to the inverting input terminal of the comparator 9. The voltage VD2 is a voltage generated in the second diode section D2.

Hereinafter, the voltage VD1 generated in the first diode section D1 may be referred to an anode voltage of the first diode section D1. The sum voltage VD2+Vout may be referred to an anode voltage of the second diode section D2. Note that the anode voltage of the first diode section D1 is equal to a falling voltage of the diode section D1 in a forward direction. The voltage VD2 generated in the second diode section D2 is equal to a falling voltage of the second diode section D2 in a forward direction.

A node between the anode of the first diode section D1 and the anode of the second diode section D2 has a reference voltage applied to the inverting input terminal of the comparator 9. This reference voltage is equal to the anode voltage of the first diode section D1 or the anode voltage of the second diode section D2.

The judgment circuit 6 includes the comparator 9. The anode of the first diode section D1 and the anode of the second diode section D2 are connected to the inverting input terminal of the comparator 9. A non-inverting input terminal of the comparator 9 is connected to the output terminal of the differential amplifier 8. An output terminal of the comparator 9 is connected to the current-mirror circuit 10 included in the control voltage regulation circuit 7.

The comparator 9 compares the detection voltage with the reference voltage. The comparator 9 outputs a low level voltage (OFF signal) when a level of the detection voltage is lower than that of the reference voltage. Note that the OFF signal may be referred to an overcurrent non-detection signal. On the other hand, the comparator 9 outputs a high level voltage (ON signal) when a level of the detection voltage is higher than that of the reference voltage. Note that the ON signal may be referred to overcurrent detection signal.

When the comparator 9 outputs the OFF signal, the overcurrent is not detected. When the comparator 9 outputs the ON signal, the overcurrent is detected. That is, the comparator 9 detects if the overcurrent is generated by comparing the detection voltage with the reference voltage. Note that the reference voltage is VD1 or D2+Vout.

As mentioned above, the control voltage regulation circuit 7 includes the current-mirror circuit 10, and the error amplifier 2. An operational mode of the control voltage regulation circuit 7 is determined based on the output signals (ON signal and OFF signal) from the comparator 9.

The current-mirror circuit 10 includes a couple of N-type transistors M3 and M4. The gate terminals of the transistors M3 and M4 are mutually connected. A drain terminal of the transistor M3 is connected to a node between the gate terminals of the transistors M3 and M4.

An output terminal of the comparator 9 is connected to the gate terminal of the transistor M3, the gate terminal of the transistor M4, and the drain terminal of the transistor M3. The source terminal of the transistor M3 and the source terminal of the transistor M4 are connected to GND. A drain terminal of the transistor M4 is connected to an internal line of the error amplifier 2. The error amplifier 2 includes a third input terminal in addition to an inverting input terminal and a non-inverting input terminal. The drain terminal of the transistor M4 is connected to the third input terminal of the error amplifier 2.

When the comparator 9 outputs the ON signal (the overcurrent detection signal), the current-mirror circuit 10 becomes ON-state. At this time, current flows from the internal line of the error amplifier 2 to GND via the transistor M4.

And the error amplifier 2 increases a level of the control voltage so as to increase the on-resistance of the output transistor M1. In other words, the error amplifier 2 controls the output transistor M1 so as to set the on-resistance of the output transistor M1 higher.

When the comparator 9 outputs the OFF signal (the overcurrent non-detection signal), the current-mirror circuit 10 becomes OFF-state. In this case, no current flows from the internal line of the error amplifier 2 to the GND via the transistor M4. It is regarded that the current-mirror circuit 10 is not connected to the third input terminal of the error amplifier 2 in this case.

Figure 2:
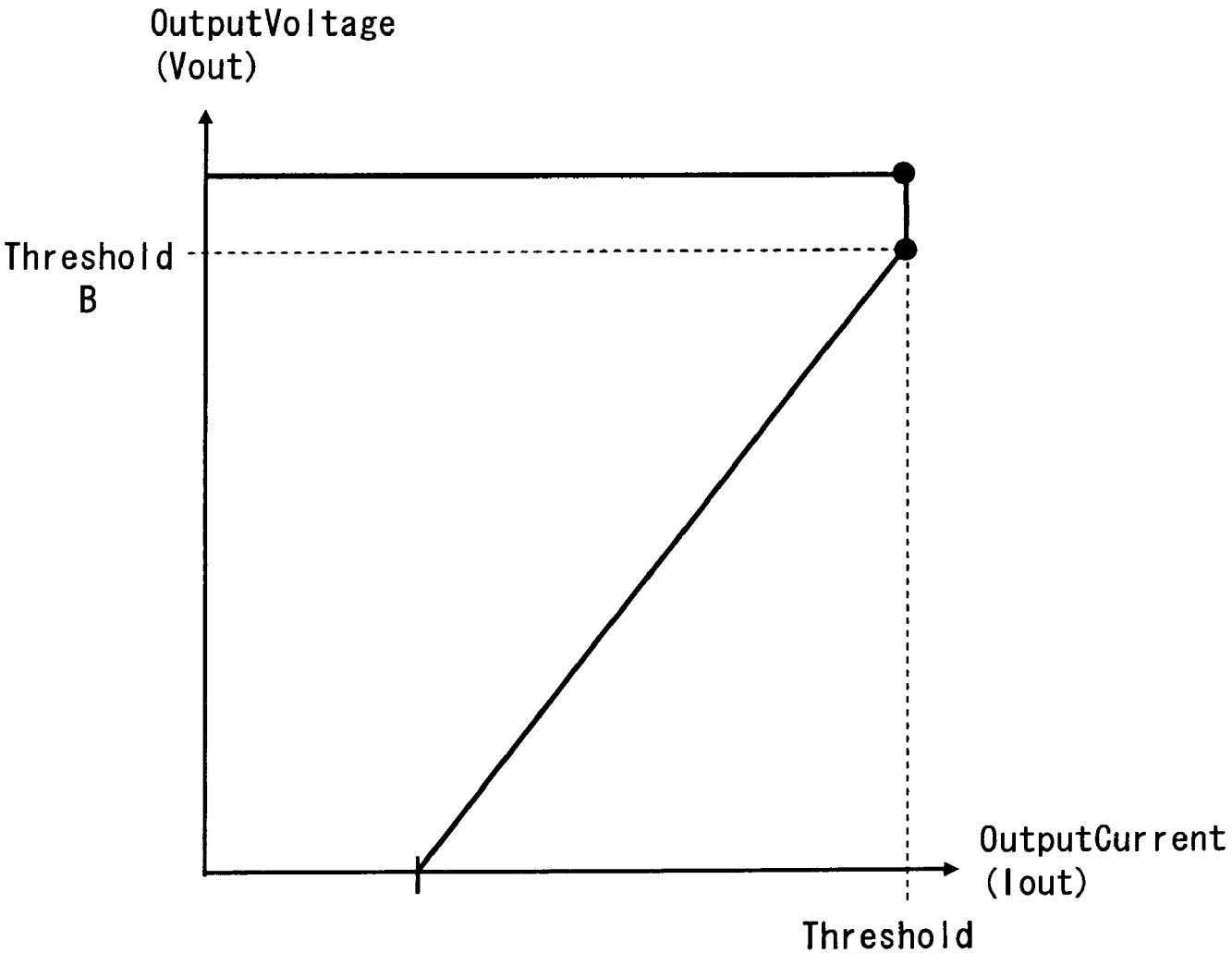
FIG. 2 is a schematic view for explaining a characteristic of the voltage supply circuit.

With reference to FIG. 2, an operation of the overcurrent protection circuit when an amount of the first current I1 increases over a predetermined threshold A is explained below. If the overcurrent protection circuit does not operate suitably, the output transistor M1 is short circuited by heat and a function of the voltage supply circuit 1A is damaged.

At a given time T0, a resistance value of the load Z connected to the output terminal Po starts to decrease. The first current I1 increases corresponding to the decrease of the resistance value of the load Z. The second current I2 also increases as the first current I1 increases. The second current I2 reflects an amount of current of the first current I1. Then, the output current Iout increases over a predetermined threshold A.

Note that the detection voltage corresponding to the second current I2 is generated between both ends of the resistor R31. This detection voltage is amplified by the differential amplifier 8 and applied to the non-inverting input terminal of the comparator 9.

When the detection voltage, applied from the differential amplifier 8 to the comparator 9, becomes over the reference voltage (the anode voltage VD1 of the first anode section D1), applied from the reference voltage generation circuit 5 to the comparator 9, it is detected that the output current Iout becomes over a threshold A (see FIG. 2). At this time, the comparator 9 outputs the ON signal (the overcurrent detection signal) to the current-mirror circuit 10 instead of the OFF signal (the overcurrent non-detection signal). Then the current-mirror circuit 10 becomes ON state. And then the error amplifier 2 increases a level of the control voltage applied to the gate terminal of the output transistor M1 so as to set the on-resistance of the output transistor M1 higher.

Note that the anode voltage VD1 of the first diode section D1 is applied to the inverting input terminal of the comparator 9 as the reference voltage at this time. The anode voltage VD2+Vout of the second anode section D2 is much higher than the anode voltage VD1 of the first diode section D1 at this time. This is because almost all of current from the current source CS1 flows into the first diode section D1.

An increase in the first current I1 that flows in the output transistor M1 is suppressed by setting the on-resistance of the output transistor M1 higher. And the output voltage Vout starts to decrease corresponding to the decrease of the resistance value of the load Z connected to the output terminal Po with maintaining the output current Iout constant.

As shown in FIG. 2, when the output voltage Vout becomes below a threshold B, the reference voltage applied to the inverting input terminal of the comparator 9 is set to the anode voltage VD2+Vout of the second diode section D2 instead of the anode voltage VD1 of the first diode section D1. In other words, the second diode section D2 becomes more predominant in setting the reference voltage at the time the output voltage Vout becomes below the threshold B.

Further explanation is added to this point. The output voltage Vout starts to decrease at the time the resistance value of the load Z connected to the output terminal Po starts to decrease with maintaining the first current I1 constant. Then the anode voltage VD2+Vout of the second diode section D2 starts to decrease and becomes below the anode voltage VD1 of the first diode section D1. At this time, current from the current source CS1 starts to flow into the second diode section D2 instead of flowing into the first diode section D1. And the reference voltage applied to the inverting input terminal of the comparator 9 is set to the anode voltage VD2+Vout of the second diode section D2. In other words, the second diode section D2 becomes predominant in setting of the reference voltage and the first diode section D1 becomes less predominant in setting of the reference voltage.

Note that the number of diode included in the first diode section D1 is three and the number of diode included in the second diode section D2 is one. The number of diode included in the first diode section D1 is larger than the number of diode included in the second diode section D2. Therefore, the switching of a current path is realized suitably.

The output voltage Vout starts to decrease as the resistance value of the load Z connected to the output terminal Po starts to decrease. Then the anode voltage VD2+Vout of the second diode section D2 starts to decrease. Then, the reference voltage starts to decrease as the output voltage Vout starts to decrease because the reference voltage applied to the inverting input terminal of the comparator 9 is set to the anode voltage VD2+Vout of the second diode section D2 at this time. As the reference voltage starts to decrease as explained above, the comparator 9 starts to output the ON signal (the overcurrent detection signal) at lower detection voltage. Then the current-mirror circuit 10 becomes ON state and an amount of the first current I1 is set to be lower.

By repeating this cycle, the output current Iout is set to be lower as with the output voltage as shown in FIG. 2. And the heating loss of the voltage supply circuit 1A is effectively suppressed.

In this embodiment, an operation of the overcurrent protection circuit starts when the first current I1 becomes over the threshold A. The error amplifier 2 controls a level of the control voltage applied to the gate terminal of the output transistor M1 so as to suppress an increase in the first current I1. Then the reference voltage applied to the comparator 9 is shifted from VD1 to VD2+Vout when the output voltage Vout becomes below the threshold B as a resistance value of the load Z becomes lower. And the output current Iout is set to be lower as with the output voltage as shown in FIG. 2.

Switching of the reference voltage is further explained. When the output voltage becomes below the threshold B, VD2+Vout becomes below VD1. Then current from the current source CS1 starts to flow into the second diode section D2 instead of flowing into the first diode section D1. Then the switching of the current path is realized. In this way, a reference voltage applied to the inverting input terminal of the comparator 9 is set to VD2+Vout instead of VD1. After the reference voltage is set to VD2+Vout, the reference voltage decreases as the output voltage Vout decreases. And the output current Iout decreases in addition to the output voltage Vout.

In this embodiment, the drain terminal of the reference transistor M2 is connected to the output terminal Po. The second current I2 flows into the output terminal Po via the reference transistor M2 suitably. And power consumption of the voltage supply circuit 1A is effectively suppressed.

Further explanation about this point is made with a reference to comparison example.

Figure 3:
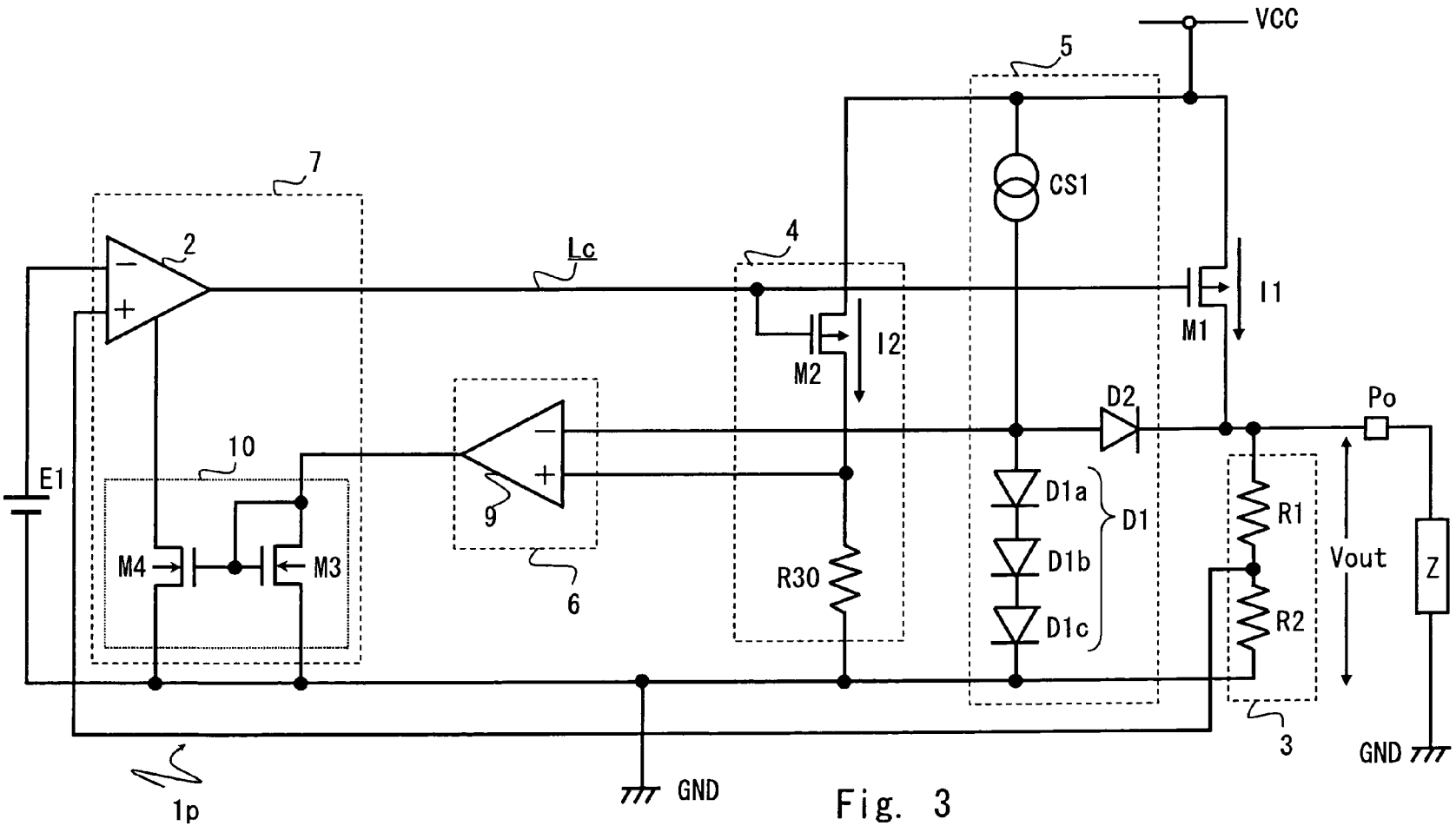
FIG. 3 is a schematic circuit diagram of a voltage supply circuit for comparison.

FIG. 3 shows a voltage supply circuit 1p as the comparison example. The difference between FIG. 1 and FIG. 3 is a configuration of the detection circuit 4. The detection circuit 4 of the voltage supply circuit 1p only includes a reference transistor M2 and a resistor R30. One end of the resistor R30 is connected to a drain terminal of the reference transistor M2 and the other end of that is connected to GND.

In this comparison example, the second current I2 flows into GND via the reference transistor M2. The second current I2 increases or decreases as the first current I1 increases or decreases. As the first current I1 increases, the internal current consumption of the voltage supply circuit 1p also increases in this comparison example.

Figure 4:
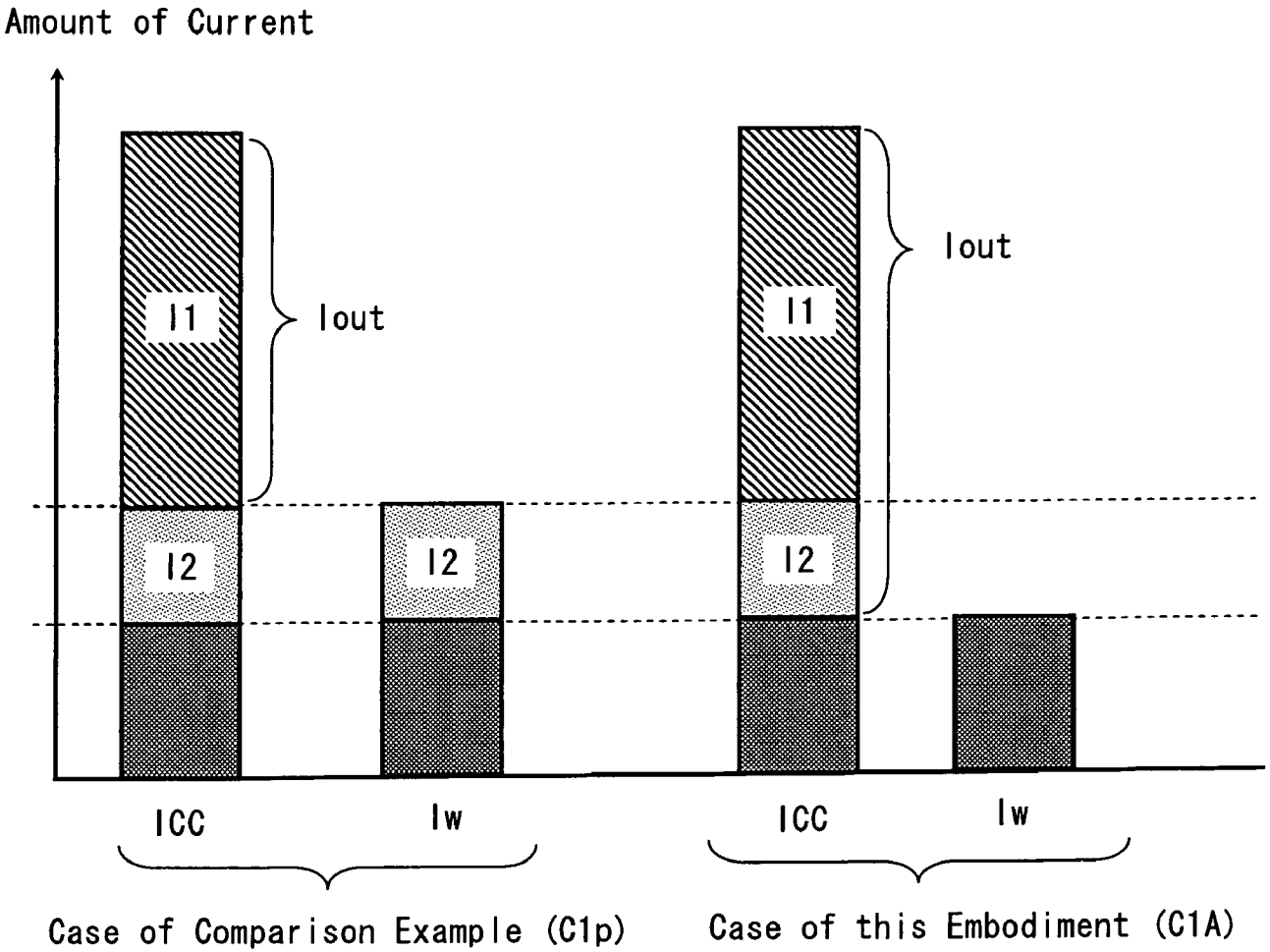
FIGS. 4 and 5 are schematic view for explaining a difference in an amount of internal current consumption of each case.

The internal current consumption IW of the voltage supply circuit of each case is shown in FIG. 4. Note that Iw=Icc−Iout. The internal current consumption Iw is equal to a difference between ICC (a total amount of current that flows inside the voltage supply circuit) and Iout.

In both case of comparison example (C1p) and this embodiment (C1A), the second current I2 increases as the first current I1 increases, and the ICC increases as the first current I1 and the second current I2 increase.

In comparison example (C1p), the output current Iout is equal to the first current I1. Therefore, the second current I2 is not subtracted from the ICC by subtracting the output current Iout from the ICC.

In this embodiment (C1A), the output current Iout is equal to a sum of the first current I1 and the second current I2. Therefore, the second current is subtracted from the ICC by subtracting the output current Iout from the ICC. The Iw is effectively suppressed by the amount of the second current I2 compared with the case of comparison example.

The internal consumption current Iw is also set to constant in this embodiment even if the output current Iout increases.

Figure 5:
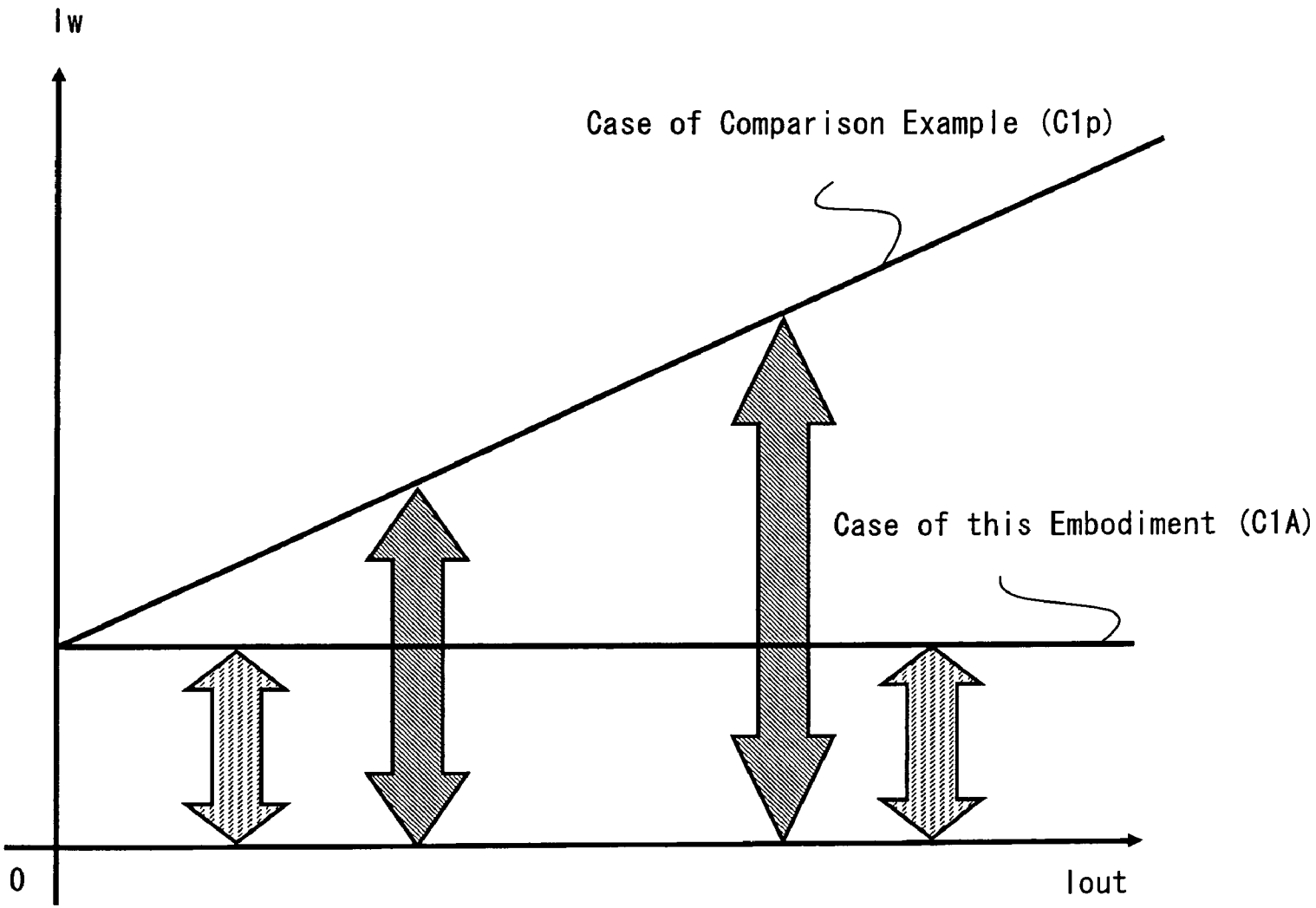

FIG. 5 shows how the internal current consumption Iw changes when the output current Iout increases in each case.

In comparison example, the internal current consumption Iw increases as the output current Iout increases. On the other hand, in this embodiment, the internal current consumption IW is constant even if the output current Iout increases. The power consumption of the voltage supply circuit 1A is set to be lower by setting the internal current consumption Iw lower regardless of the increase in the output current Iout.

Second Embodiment

Figure 6:
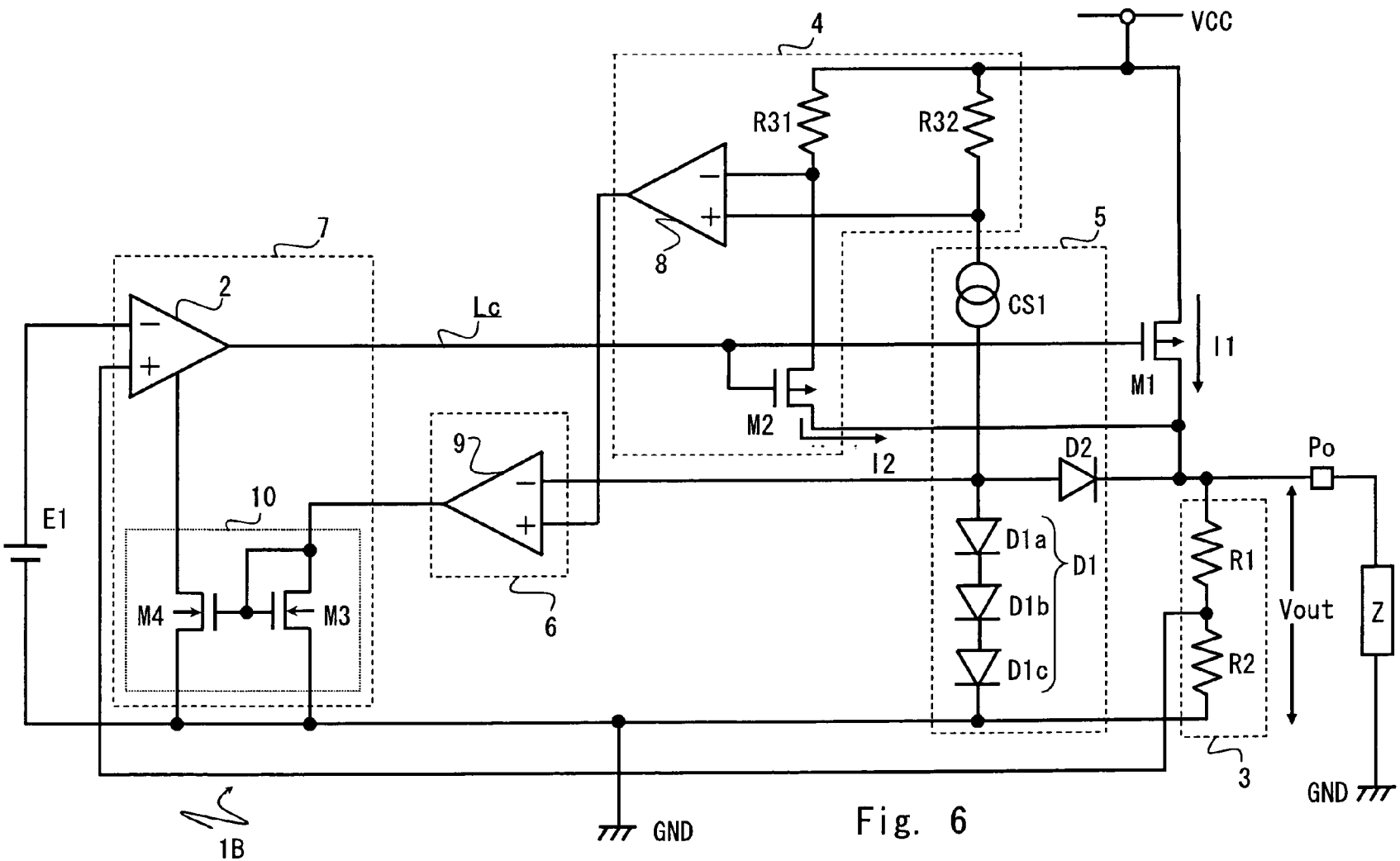
FIG. 6 is a schematic circuit diagram of a voltage supply circuit according to a second embodiment of the present invention.

FIG. 6 shows a voltage supply circuit 1B according to the second embodiment of this invention. The difference between first and second embodiments is a configuration of the detection circuit 4. That is, the non-inverting input terminal of the differential amplifier 8 is connected to anode between a resistor R32 (second resistor) and the reference voltage generation circuit 5.

In this embodiment, the differential amplifier 8 amplifies a difference between a voltage at a second end of a resistor R31 and a voltage at a second end of the resistor R32. The differential amplifier 8 uses a voltage at the second end of the resistor R32 connected between the current source CS1 and the power supply voltage VCC. By having such a configuration, there is no need to provide a circuit only for generating a reference voltage applied to the non-inverting input terminal of the differential amplifier 8. Therefore, an increase in the internal current consumption of the voltage supply circuit 1B is effectively suppressed.

Note that the differential amplifier 8 may be configured as a comparator. In this case, the comparator outputs a high level voltage or a low level voltage based on comparison between the voltage at the second end of the resistor R31 and the voltage at the second end of the resistor R32.

The comparator outputs the high level voltage when the voltage at the second end of the resistor R31 is lower than the voltage at the second end of the resistor R32. In other words, the comparator outputs the high level voltage when an amount of falling voltage caused by the resistor R31 is larger than an amount of falling voltage caused by the resistor R32.

The comparator outputs the low level voltage when the voltage at the second end of the resistor R31 is higher than the voltage at the second end of the resistor R32. In other words, the comparator outputs the low level voltage when an amount of falling voltage caused by the resistor R31 is smaller than an amount of falling voltage caused by the resistor R32.

Third Embodiment

Figure 7:
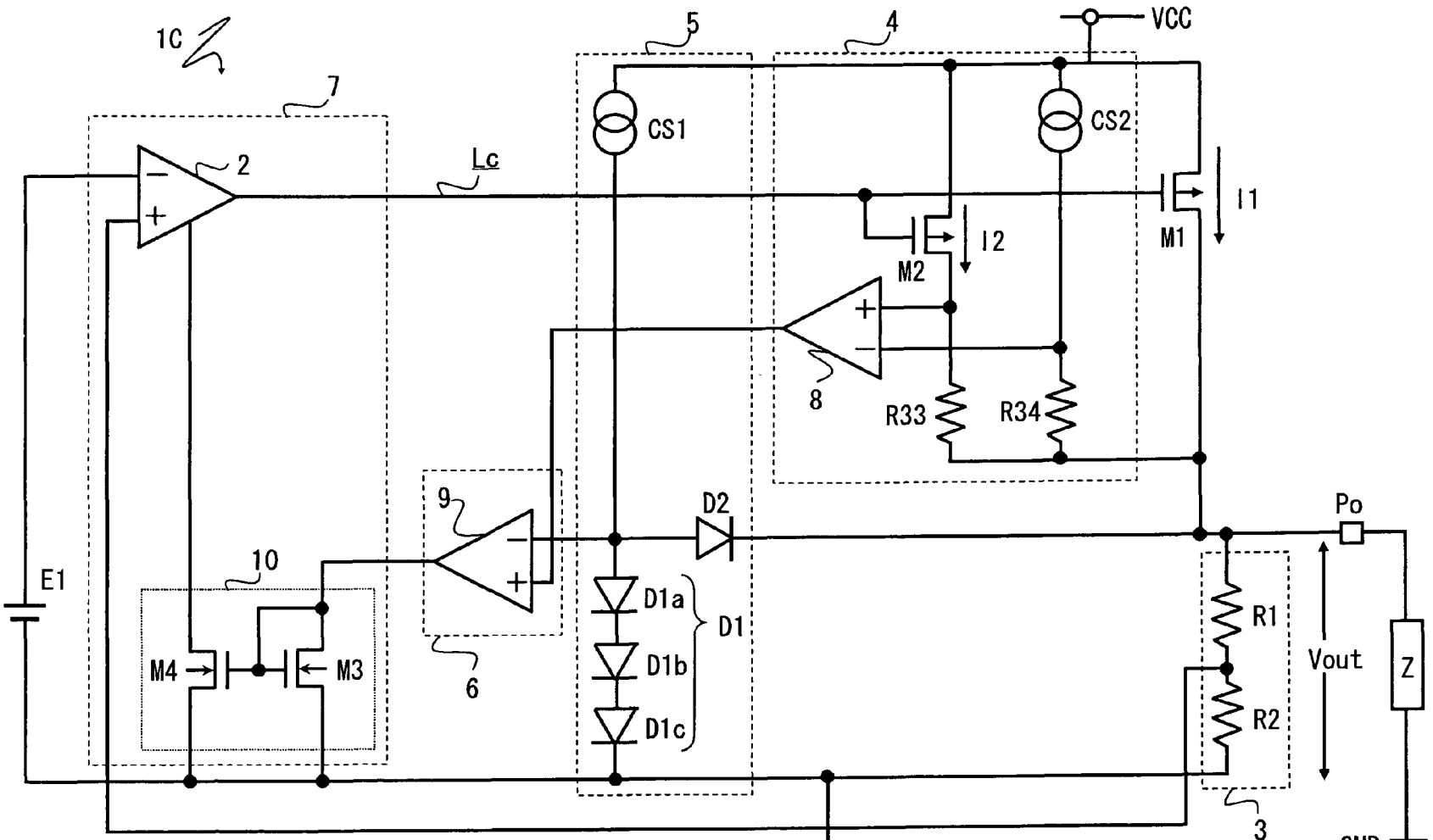
FIG. 7 is a schematic circuit diagram of a voltage supply circuit according to a third embodiment of the present invention.

FIG. 7 shows a voltage supply circuit 1C according to a third embodiment of this invention. The difference between the first embodiment and this embodiment is a configuration of the detection circuit 4. The non-inverting input terminal of the differential amplifier 8 is connected to a node between the reference transistor M2 and a resistor R33. The inverting input terminal of the differential amplifier 8 is connected to a node between a current source CS2 and a resistor R34.

The differential amplifier 8 amplifies a difference voltage between a voltage at a first end of the resistor R33 (first resistor) and a voltage at a first end of the resistor R34 (second resistor).

In this embodiment, a second end of the resistor R34 is connected to the output terminal Po. Therefore, an increase in internal current consumption of the voltage supply circuit 1C is suppressed even if the current source CS2 and the resistor R34 are added as for a circuit to generate the reference voltage.

Note that the differential amplifier 8 may be configured as a comparator. In this case, the comparator outputs a high level voltage or a low level voltage based on comparison between the voltage at the first end of the resistor R33 and the voltage at the first end of the resistor R34.

The comparator outputs the low level voltage when the voltage at the first end of the resistor R33 is lower than the voltage at the first end of the resistor R34. In other words, when a voltage generated between both ends of the resistor R33 becomes lower than a voltage generated between both ends of the resistor R34, the comparator outputs the low level voltage.

The comparator outputs the high level voltage when the voltage at the first end of the resistor R33 is higher than the voltage at the first end of the resistor R34. In other words, when a voltage generated between both ends of the resistor R33 becomes higher than a voltage generated between both ends of the resistor R34, the comparator outputs the high level voltage.

Fourth Embodiment

Figure 8:
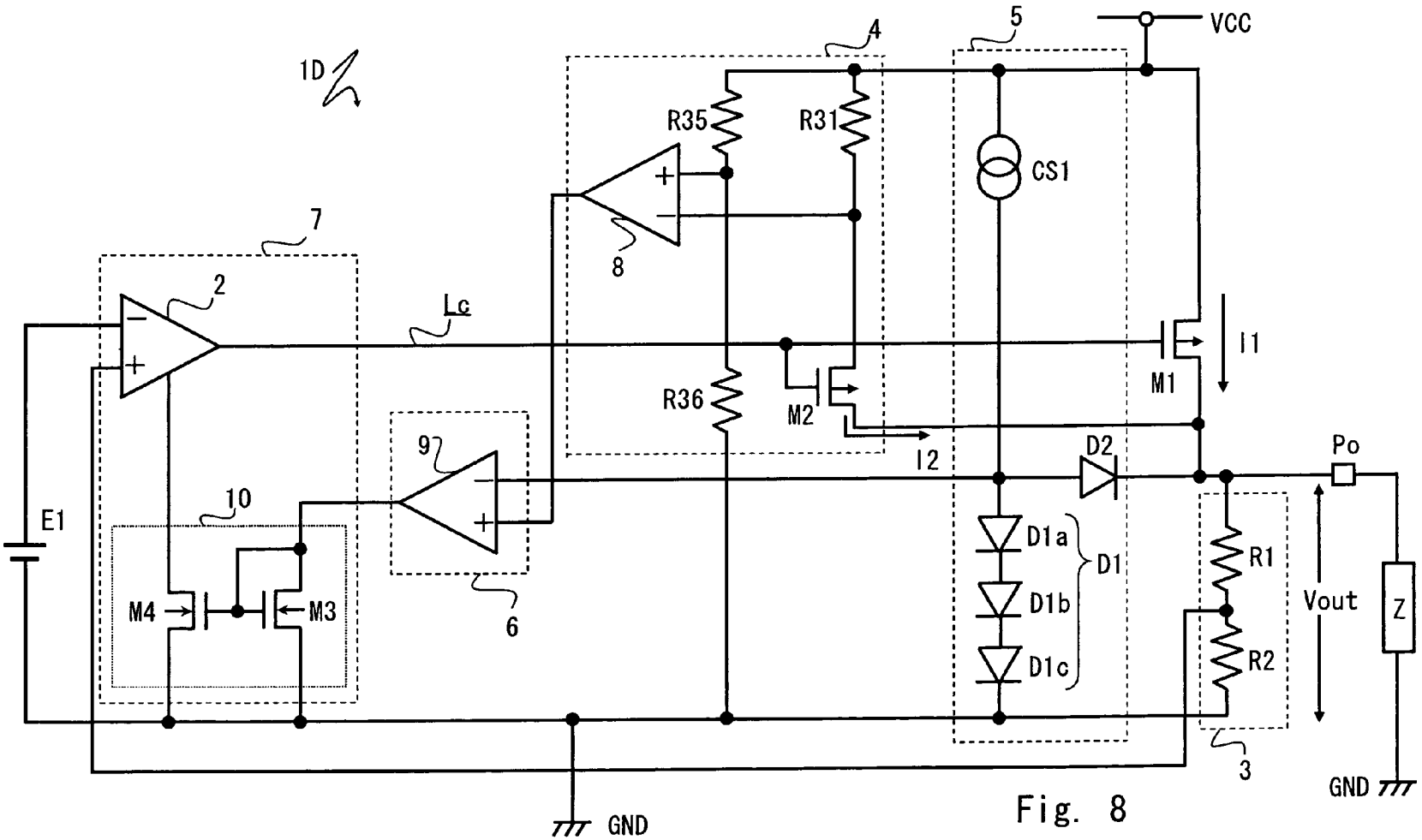
FIG. 8 is a schematic circuit diagram of a voltage supply circuit according to a forth embodiment of the present invention.

FIG. 8 shows a voltage supply circuit 1D according to the forth embodiment of this invention. The difference between the first embodiment and this embodiment is a configuration of the detection circuit 4. The inverting input terminal of the differential amplifier 8 is connected to a node between the resistor R31 and the reference transistor M2. The non-inverting input terminal of the differential amplifier 8 is connected to a node between a resistor R35 (second resistor) and a resistor R36 (third resistor).

The differential amplifier 8 amplifies a difference voltage between a voltage at a second terminal of the resistor R35 and a voltage at a second terminal of the resistor R31.

In this embodiment, resistors R35 and R36 are provided for generating a reference voltage applied to the non-inverting input terminal of the differential amplifier 8. It is possible to detect the detection voltage with high accuracy just by setting resistance values of each resistor R35 and R36. And it becomes possible to detect the overcurrent precisely.

Note that the differential amplifier 8 may be configured as a comparator. In this case, the comparator outputs a high level voltage or a low level voltage based on comparison between the voltage at the second end of the resistor R31 and the voltage at the second end of the resistor R35.

The comparator outputs the high level voltage when the voltage at the second end of the resistor R31 is lower than the voltage at the second end of the resistor R35. In other words, the comparator outputs the high level voltage when an amount of falling voltage caused by the resistor R31 is larger than an amount of falling voltage caused by the resistor R35.

The comparator outputs the low level voltage when the voltage at the second end of the resistor R31 is higher than the voltage at the second end of the resistor R35. In other words, the comparator outputs the low level voltage when an amount of falling voltage caused by the resistor R31 is smaller than an amount of falling voltage caused by the resistor R35.

Fifth Embodiment

Figure 9:
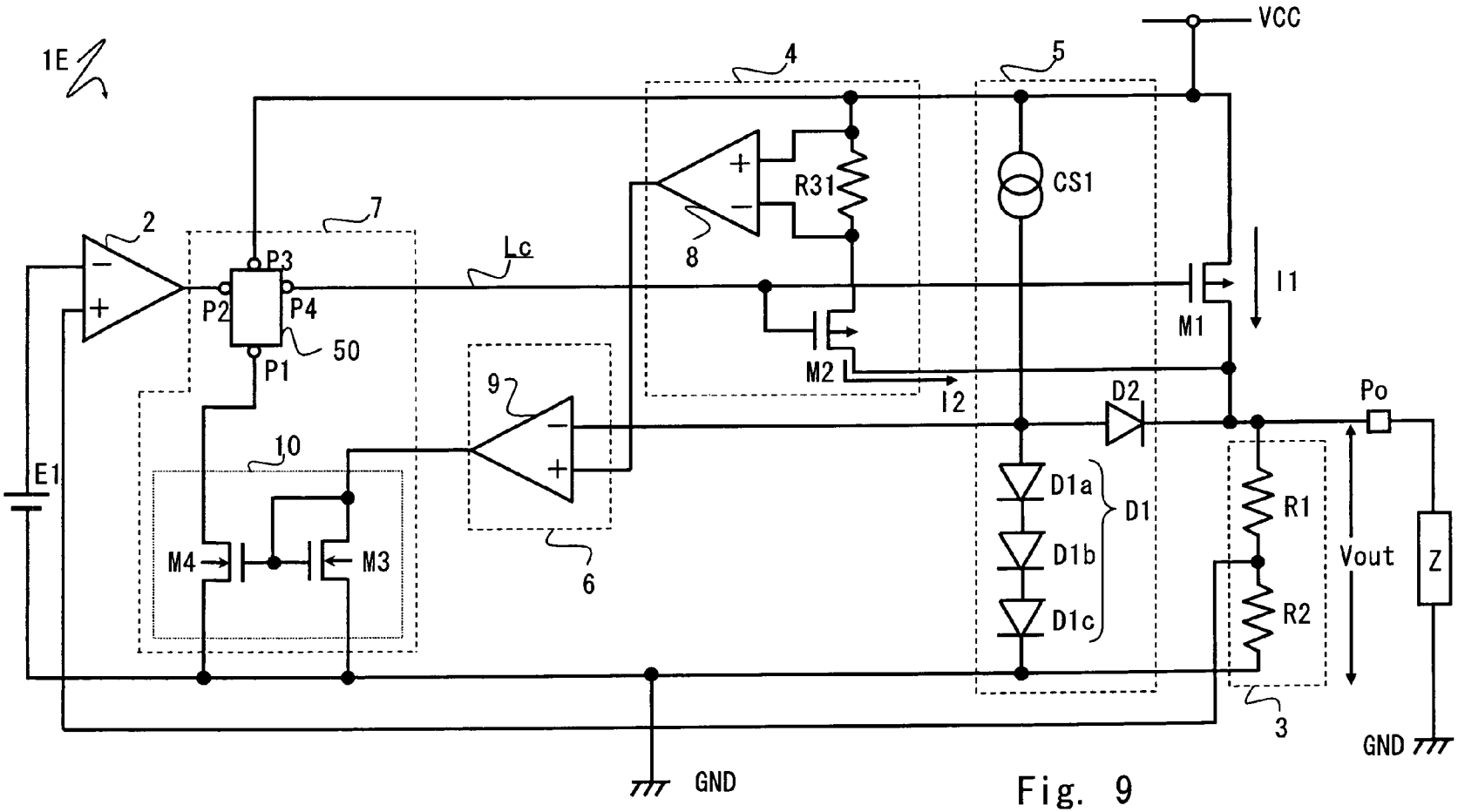
FIG. 9 is a schematic circuit diagram of a voltage supply circuit according to a fifth embodiment of the present invention.

FIG. 9 shows a voltage supply circuit 1E according to the fifth embodiment of this invention. The difference between the first embodiment and this embodiment is a configuration of the control voltage regulation circuit 7. The control voltage regulation circuit 7 includes a middle control circuit 50 between the output terminal of the error amplifier 2 and the gate terminal of the output transistor M1 in addition to the current-mirror circuit 10.

The output terminal of the error amplifier 2 is connected to a terminal P2 of the middle control circuit 50. The gate terminal of the output transistor M1 is connected to a terminal P4 of the middle control circuit 50. The drain terminal of the transistor M4 included in the current-mirror circuit 10 is connected to a terminal P1 of the middle control circuit 50. The power supply voltage VCC is applied to a terminal P3 of the middle control circuit 50.

Figure 10:
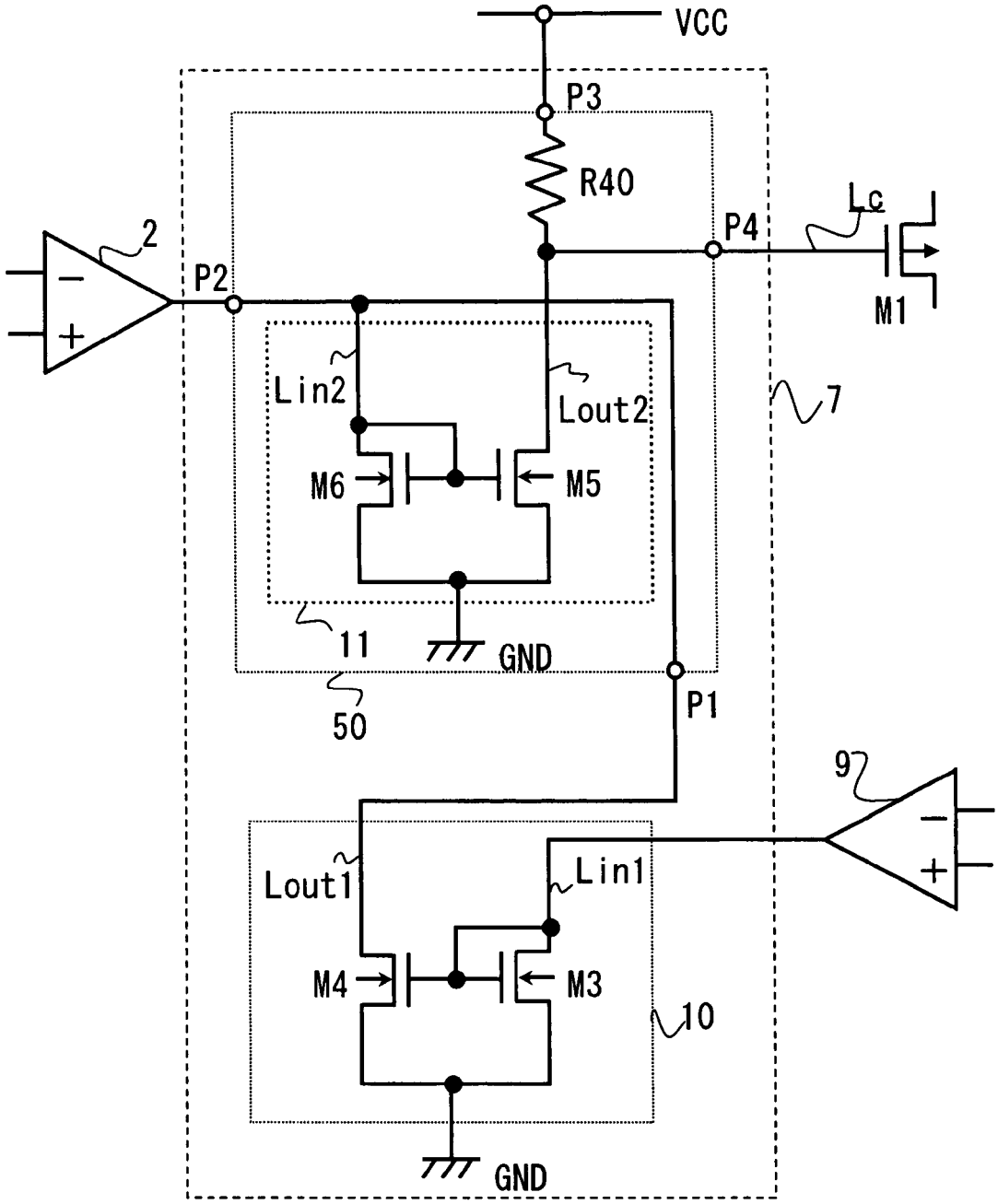
FIG. 10 is a schematic circuit diagram for explaining a middle control circuit included in a voltage supply circuit according to the fifth embodiment of the present invention.

FIG. 10 shows a circuit diagram of the middle control circuit 50. As shown in FIG. 10, the middle control circuit 50 has a current-mirror circuit 11 including a couple of transistors M5 and M6.

The current-mirror circuit 11 includes the transistor M5 and the transistor M6. A gate terminal of the transistor M5 and a gate terminal of the transistor M6 are mutually connected. A drain terminal of the transistor M6 is connected to a node between the gate terminal of the transistor MS and the gate terminal of the transistor M6.

A drain terminal of the transistor M6 is connected to the output terminal of the error amplifier 2 via the terminal P2. Source terminals of the transistors MS and M6 are connected to GND. A drain terminal of the transistor MS is connected to the gate terminal of the output transistor M1 via the terminal P4. A resistor R40 is connected between VCC and the transistor MS. A first end of the resistor R40 is connected to VCC via the terminal P3. A second end of the resistor R40 is connected to the drain terminal of the transistor MS.

The drain terminal of the transistor M4 included in the current-mirror circuit 10 is connected to the output terminal of the error amplifier 2 via the terminals P1 and P2. An input line Lin2 of the current-mirror circuit 11 and an output line Lout1 of the current-mirror circuit 10 are connected to the output terminal of the error amplifier 2 in parallel.

In a normal operation, the current-mirror circuit 10 is in OFF state. Therefore, it is regarded that the current-mirror circuit 10 is not connected to the output terminal of the error amplifier 2.

In a protection operation, where the detection voltage becomes over the reference voltage, the comparator 9 outputs ON signal and the current-mirror circuit 10 becomes ON state.

Then the current-mirror circuit 10 pulls a current having an amount corresponding to a voltage level of the ON signal from the output terminal of the error amplifier 2. An amount of current that flows in the output line Lout2 of the current-mirror circuit 11 decreases as an amount of current that flows in the input line Lin2 of the current-mirror circuit 11 decreases.

Thus a potential level at a node between the resistor R40 and the transistor M5 becomes higher as an amount of current that flows into the output line Lout2 of the current-mirror circuit 11 decreases. Then a level of the control voltage applied to the gate terminal of the output transistor M1 is set higher and the on-resistance of the output transistor M1 is set higher. As a result, the first current I1 starts to decrease and it is suppressed that the output transistor M1 is damaged by the overcurrent.

Note that the error amplifier 2 does not need to have the third input terminal in this embodiment. A general amplifier can be used as the error amplifier 2.

Sixth Embodiment

Figure 11:
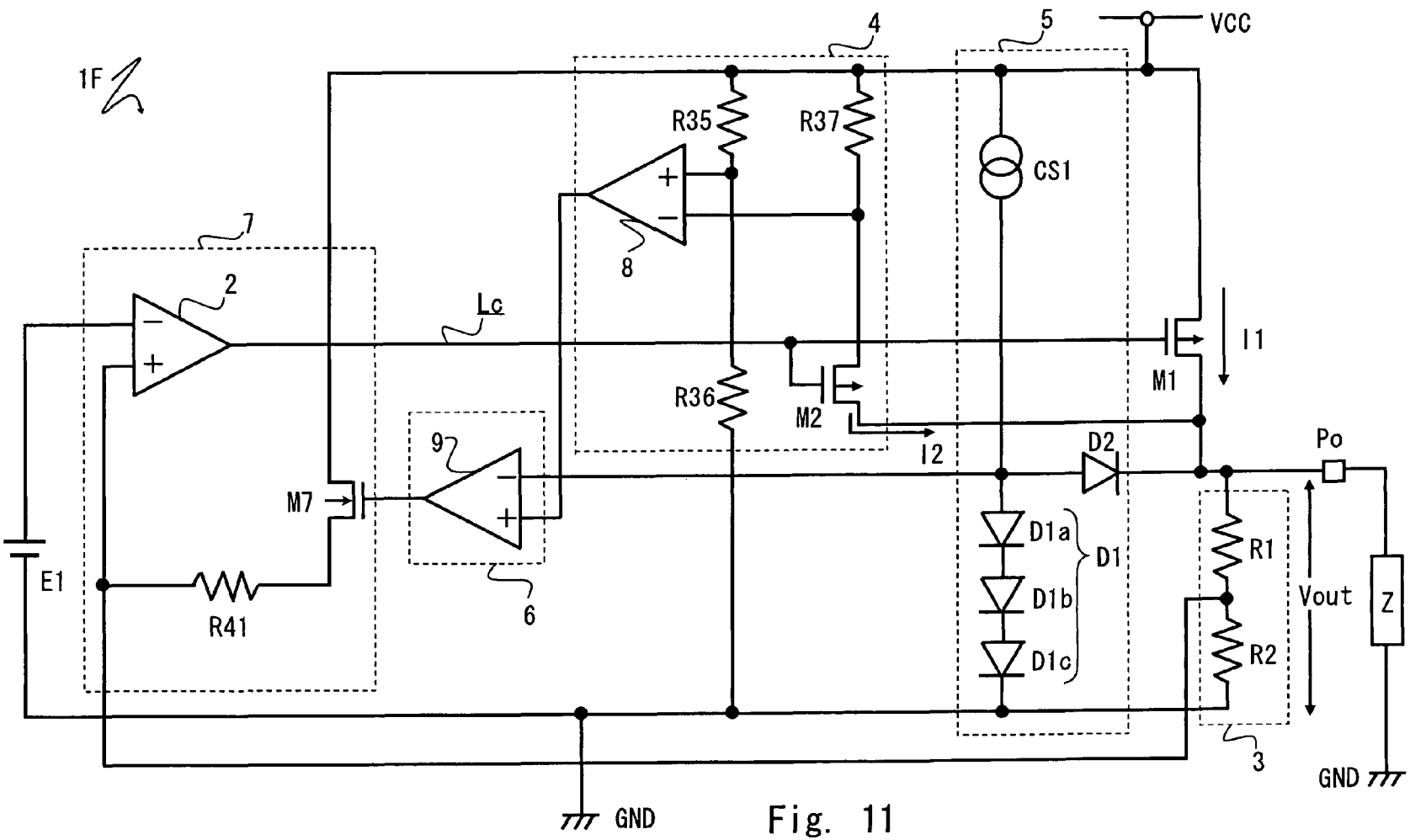
FIG. 11 is a schematic circuit diagram of a voltage supply circuit according to a sixth embodiment of the present invention.

FIG. 11 shows a voltage supply circuit 1F according to the sixth embodiment of this invention. The difference between the forth embodiment and this embodiment is a configuration of the control voltage regulation circuit 7.

The control voltage regulation circuit 7 includes a n-type transistor M7, a resistor R41, and the error amplifier 2. The gate terminal of the transistor M7 is connected to the output terminal of the comparator 9. A source terminal of the transistor M7 is connected to a first end of the resistor R41. The first end of the resistor R41 is connected to the source terminal of the transistor M7. A second end of the resistor R41 is connected to the first end of the resistor R2.

The transistor M7 becomes ON state when the comparator 9 outputs the ON signal that is output when the overcurrent that flows in the output transistor M1 is detected. Current flows from power supply voltage VCC to GND via the transistor M7, the resistor R41, and the resistor R2. The voltage difference between both ends of the resistor R2 increases as an amount of the current that flows in the resistor R2 increases. Then a level of the control voltage applied from the error amplifier 2 to the output transistor M1 increases and on-resistance of the output transistor M1 increases. Thus, the output transistor M1 is protected from the overcurrent.

In this embodiment, the output transistor M1 is protected from the overcurrent by controlling the divided voltage input to the non-inverting input terminal of the error amplifier 2. Therefore, it is possible to simplify the configuration of the voltage supply circuit 1F. Also there is no need to provide the third input terminal at the error amplifier 2. A general amplifier could be used for the error amplifier 2. Also it is possible to configure the control voltage regulation circuit 7 by just adding the transistor M7 and the resistor R41 to the error amplifier 2.

It is apparent that the present invention is not limited to the above embodiment but may be modified and changed without departing from the scope and spirit of the invention. There are other methods for limiting the first current I1 based on the overcurrent detection signal output from the comparator 9. It is possible to reverse the p-type and n-type. A bipolar-transistor may be used for the transistor.

What is claimed is:

1. A voltage supply circuit comprising:

an output transistor producing a first current flowing into an output terminal in response to a control voltage supplied thereto from an error amplifier; and an overcurrent protection circuit including a reference transistor producing a second current flowing into the output terminal relative to the first current, the overcurrent protection circuit regulating the control voltage in response to a comparison between a detection voltage based on the second current and a reference voltage.

2. The voltage supply circuit according to claim 1, wherein the overcurrent protection circuit further comprises:

a comparator comparing the reference voltage with the detection voltage to output an overcurrent detection signal, wherein the overcurrent protection circuit regulates the control voltage based on the overcurrent detection signal.

3. The voltage supply circuit according to claim 2, wherein the overcurrent protection circuit further comprises:

a detection circuit generating the detection voltage based on the second current.

4. The voltage supply circuit according to claim 3, wherein the overcurrent protection circuit further comprises:

a reference voltage generation circuit generating the reference voltage.

5. The voltage supply circuit according to claim 2, wherein the overcurrent protection circuit further comprises:

a control voltage regulation circuit regulating the control voltage so as to decrease an amount of the first current based on the overcurrent detection signal.

6. The voltage supply circuit according to claim 4, wherein the reference voltage generation circuit includes:

a current source;

a first diode section having an anode connected to the current source; and a second diode section having an anode connected to the current source and a cathode connected to the output terminal of the voltage supply circuit, wherein the reference voltage is changed based on a shift from a first current path including the first diode section to a second current path including the second diode section.

7. The voltage supply circuit according to claim 6, wherein a number of diode included in the second diode section is less than the number of diode included in the first diode section.

8. A voltage supply circuit comprising:

an output transistor outputting a first current to an output terminal in response to a control voltage applied thereto from an error amplifier;

a reference transistor outputting a second current relative to the first current to the output terminal;

a comparator comparing a detection voltage based on the second current with a reference voltage to produce an overcurrent detection signal; and a control voltage regulation circuit regulating a level of the control voltage in response to the overcurrent detection signal.

9. The voltage supply circuit according to claim 8, wherein the control voltage regulation circuit includes the error amplifier that regulates the control voltage based on the overcurrent detection signal.

10. The voltage supply circuit according to claim 9, wherein the control voltage regulation circuit further includes a current-mirror circuit where an input line is connected to an output terminal of the comparator and an output line is connected to an internal node of the error amplifier.

11. The voltage supply circuit according to claim 8, wherein the control voltage regulation circuit includes:

a first current-mirror circuit where an input line is connected to the output terminal of the comparator and an output line is connected to the output terminal of the error amplifier; and a second current-mirror circuit where an input line is connected to the output terminal of the error amplifier and an output line is connected to the control terminal of the output transistor.

12. The voltage supply circuit according to claim 8 further comprising:

a reference voltage generation circuit generating the reference voltage.

13. The voltage supply circuit according to claim 12, wherein the reference voltage generation circuit includes:

a current source;

a first diode section having an anode connected to the current source; and a second diode section having an anode connected to the current source and a cathode connected to the output terminal of the voltage supply circuit, and wherein the reference voltage is changed based on a shift from a first current path including the first diode section to a second current path including the second diode section.

14. A voltage supply circuit comprising:

an output terminal;

an output transistor generating a first current flowing into the output terminal in response to a control voltage applied from an error amplifier;

a reference transistor generating a second current flowing into the output terminal in response to the control voltage applied from the error amplifier;

a reference voltage generation circuit generating a reference voltage;

a detection voltage generation circuit generating a detection voltage in response to the second current;

a comparator comparing the detection voltage with the reference voltage to output an overcurrent detection signal; and a regulator regulating a level of the control voltage in response to the overcurrent detection signal.

15. The voltage supply circuit according to claim 14, wherein the regulator includes the error amplifier that regulates the control voltage based on the overcurrent detection signal.

16. The voltage supply circuit according to claim 15, wherein the regulator further includes a current-mirror circuit where an input line is connected to an output terminal of the comparator and an output line is connected to an internal node of the error amplifier.

17. The voltage supply circuit according to claim 14, wherein the regulator includes:

a first current-mirror circuit where an input line is connected to the output terminal of the comparator and an output line is connected to the output terminal of the error amplifier; and a second current-mirror circuit where an input line is connected to the output terminal of the error amplifier and an output line is connected to the control terminal of the output transistor.

18. The voltage supply circuit according to claim 14 further comprising:

a voltage division circuit connected to the output terminal; and a power supply, wherein a first input terminal of the error amplifier is connected to the power supply and a second input terminal of the error amplifier is connected to an internal node of the voltage division circuit.

19. The voltage supply circuit according to claim 14, wherein the reference voltage generation circuit includes:

a current source;

a first diode section having an anode connected to the current source; and a second diode section having an anode connected to the current source and a cathode connected to the output terminal of the voltage supply circuit, wherein the reference voltage is changed based on a shift from a first current path including the first diode section to a second current path including the second diode section.

* * * * *